United States Patent [19]

Forberg

[11] 4,278,355

[45] Jul. 14, 1981

[54] METHOD OF MIXING PARTICULATE COMPONENTS

[76] Inventor: Halvor G. Forberg, Hagabakken 2, 3250 Larvik, Norway

[21] Appl. No.: 58,092

[22] Filed: Jul. 16, 1979

[30] Foreign Application Priority Data

Jul. 25, 1978 [NO] Norway ..... 782550

[51] Int. Cl.[3] ..... B01F 7/04

[52] U.S. Cl. ..... 366/300; 366/327

[58] Field of Search ..... 366/300, 301, 299, 298, 366/297, 603, 327, 329, 325

[56] References Cited

U.S. PATENT DOCUMENTS

| | | | |
|---|---|---|---|
| 2,498,237 | 2/1950 | Baymond | 366/300 |
| 3,941,357 | 3/1976 | Wurtz | 366/300 |

FOREIGN PATENT DOCUMENTS

| | | |
|---|---|---|
| 1097411 | 1/1961 | Fed. Rep. of Germany . |
| 1112968 | 8/1961 | Fed. Rep. of Germany . |
| 1116196 | 11/1961 | Fed. Rep. of Germany . |

*Primary Examiner*—Robert W. Jenkins

*Attorney, Agent, or Firm*—Finnegan, Henderson, Farabow, Garrett & Dunner

[57] ABSTRACT

A method of homogeneously mixing particulate material by means of a mixing machine which has two counter-rotating shafts provided with blades disposed at an angle to and parallel with the shafts, such that by giving the blades a specified velocity and at a specified filling level, a circulating movement of materials in the plane of the shafts is obtained, as well as a lifting of the material between the shafts into a whirling, floating zone in which the mixing takes place.

8 Claims, 4 Drawing Figures

METHOD OF MIXING PARTICULATE COMPONENTS

The invention pertains to a method of mixing particulate components such as, for example, peat, fertilizer and lime, utilizing a mixing machine which comprises a mixing chamber in which two shafts are disposed in the same horizontal plane and provided with blades arranged at an angle to and parallel with the shafts, said shafts rotating in opposite directions with an upward movement on the side where the shafts turn toward one another.

Various mixing apparatus are discussed in German Patent Publication No. 1.112.968, 1.097.411 and 1.116.196, where the purpose is to mix liquid substances that are sticky, and where it is thus desirable that the blades of the apparatus be covered by the materials during the entire rotation. The mixing itself takes place below the center of the shafts, and the particles which are to be mixed into the sticky, liquid substances are given so much energy that they are thrown from the center of the mixer to the outer wall.

The purpose of the present invention is to provide a method of mixing particulate components by which one can obtain a very homogeneous distribution of a small amount of one particulate material in a large quantity of another particulate material.

It is also a purpose of the invention to enable the effective mixture of heavy and lightweight substances, and in particular, dry substances.

Specifically, the purpose of the invention is to enable one to mix dry substances which have highly different densities effectively and in a short time. This is obtained in accordance with the invention by utilizing a mixing machine in which the particulate components are mixed by means of two counter-rotating shafts with blades, where some of the blades have different angles of incidence and different blade areas in order thereby to obtain a good mixing of the said substances.

The invention thus pertains to a method of mixing particulate components such as, for example, peat, fertilizer and lime, utilizing a mixing machine which comprises a mixing chamber in which two shafts are arranged in the same horizontal plane, the shafts being provided with blades disposed at an angle to and parallel with the shafts, the shafts rotating in opposite directions with upward movements on the side where the shafts turn toward one another, and the method is characterized in that the blades are given a peripheral rotational velocity of at least 1.2 m/sec., and that the components, in powder form, are filled into the machine to a filling height of at least the level of the shafts.

With the use of such a mixing machine, one will obtain a circulating transport movement of the powdered components in the horizontal plane while simultaneously obtaining a lifting of the particulate components in the region between the shafts, thus obtaining a mixing zone in which the particulate components are in a turbulent, floating state, thereby resulting in a very good mixing effect.

One can obtain a mixture of, for example, peat, fertilizer and lime in as short a time as only 4 seconds with a charge of 400 liters, the entire mixing process thus being carried out much more rapidly than previously possible, and in addition comes the advantage that the mixture of the substances in question will be completely homogeneous, thus resulting in an improved product.

The method can of course be utilized for mixing any kind of particulate components whatsoever, where the aim is to obtain a homogeneous mixture.

The method of the invention will be explained in greater detail below in connection with the use of a favourable type of mixing machine.

A suitable mixing machine is shown in the accompanying drawings, where

On all of the drawings, the same reference numerals are used to designate the same parts.

Figure 1:
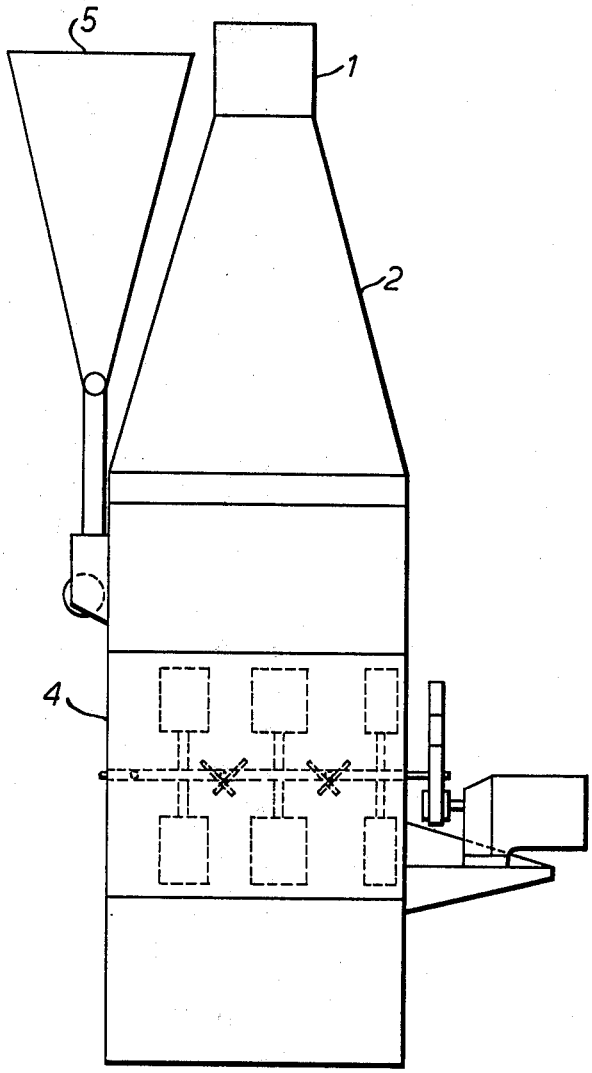
FIG. 1 shows the complete apparatus, seen from the side.
Figure 2:
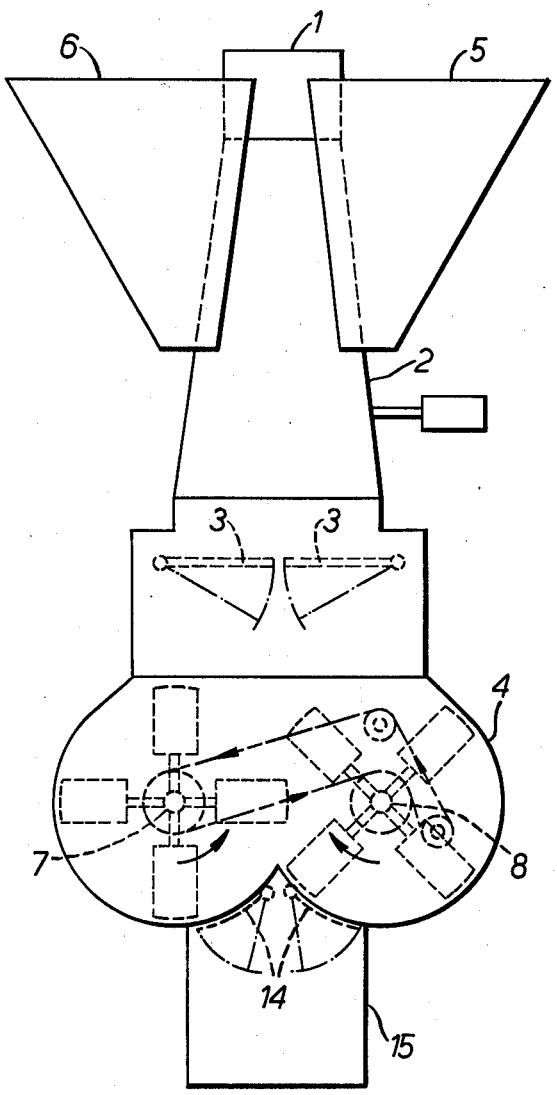
FIG. 2 is a front view of the apparatus.
Figure 3:
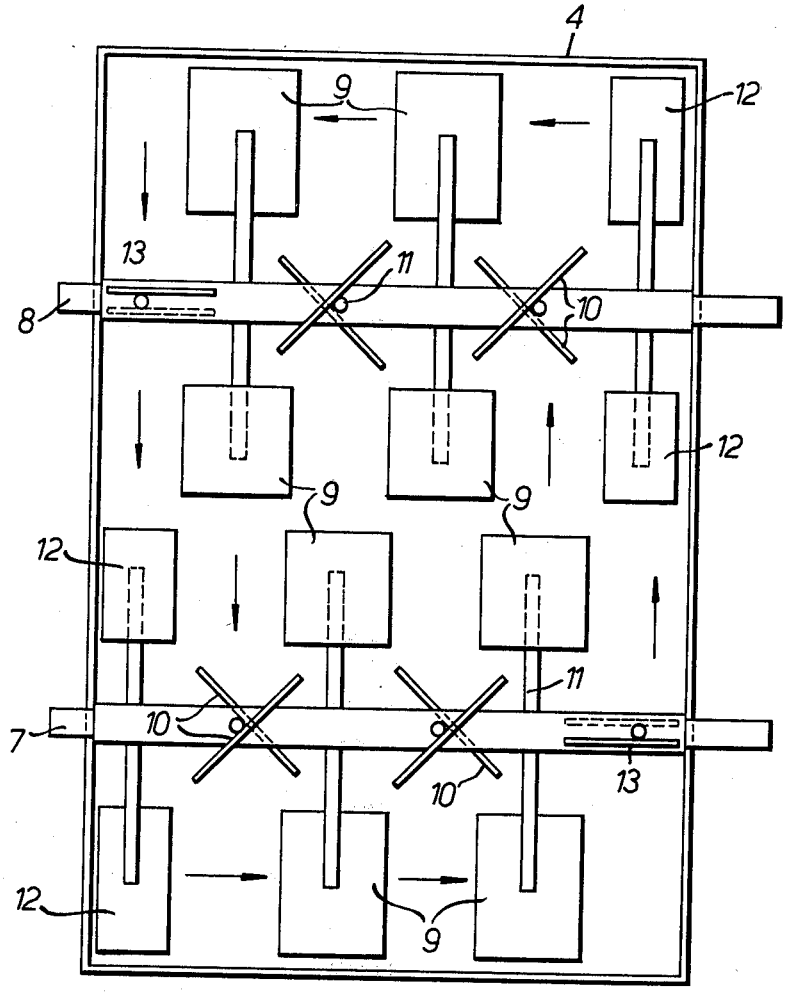
FIG. 3 shows the mixing members of the apparatus.

Through a hopper 1, peat, for example, is fed into a silo 2, from which a specified volume of peat passes via two pivotable trap doors 3 into a mixing chamber 4. At the same time, fertilizer, for example, from a hopper 5, and lime, for example, from a hopper 6, are added, by means of contractors, programming machinery and metering vessels which measure out the correct quantities of additive materials and a scoop which guides the materials into the mixing chamber. As soon as the correct quantities of material have been supplied to the chamber, the mixing begins. The mixing is effected by means of two counter-rotating shafts 7 and 8. Mounted on each shaft are two opposing pairs of blades 9 of a certain area, positioned 90° transverse of the centerline for the shafts and with the blade wings disposed at a 45° angle in relation to the shaft centerline. Also disposed on both shafts are two opposing pairs of blades 10, having the same blade area, disposed 90° transverse of the shaft centerline and with the blade wings at a 45° angle, but the supports 11 for the wings are displaced 90° in relation to the supports for the wings 9. At respective opposite ends of each shaft, an opposing pair of blades 12 is disposed, aligned with the pairs of blades 9, having the same blades area and also positioned 90° transverse of the shaft centerline, but with the blade wings twisted 55° instead of 45° in relation to the shaft centerline. At the other respective opposite ends of each shaft, a pair of blades 13 is disposed, positioned 90° transverse of the shaft centerline. The wings of this pair of blades, however, are not twisted relative to the shaft centerline, but are parallel to the centerline and have a smaller blade area than the other blades.

All of the opposing blade wings are disposed on the respective ends of their respective supports 11. After the components introduced into the chamber have been effectively mixed by four different mixing movements, in that the mixture is guided down over the blades, pushed to one side or the other according to the direction of rotation, and thereafter led along the shafts in both directions, trap doors 14 open and the mixture falls down into a discharge chute 15.

Figure 4:
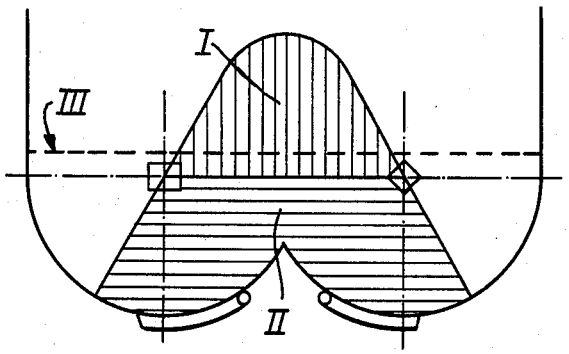
FIG. 4 shows the zones which arise in the mixing machine when the method of the invention is used.

In accordance with the method of the invention, the blades are given a peripheral rotational velocity of at least 1.2 m/sec., and the components, in powdered form, are filled into the machine to a filling height of at least the level of the shafts. In this manner, the components are made to undergo a special fluidizing or floating effect. On FIG. 4, two zones I and II are marked, zone I designating the mixing zone which is obtained with the method of the invention and zone II indicating the transport zone, i.e., the transport in the mixing system occurs below the level of the shafts and of the mixing itself, which takes place with the components in a fluidized state and occurs in zone I. If the peripheral rotational velocity of the blades is not held to at least 1.2 m/sec., and preferably between 1.2 and 1.8 m/sec., the powdered components will leave zone I and pass into the lateral zones, where one would obtain an unfortunate centrifugal effect. In that case, the heavier particles would be thrown to the side and the lighter particles would fall in between, and the mixer would then have a separator effect which is absolutely undesired. In addition, the filling height in the machine must be at least up to the level of the shafts, and preferably a little above, as indicated by the dotted line III on FIG. 4. If the fill level is reduced or increased, one obtains a reduced mixing effect even at the specified peripheral velocity. The reduced mixing zone would also be supported by the air which is introduced into the mixing zone at the specified peripheral speed of the blades.

In the preceding discussion, the invention has been described with reference to a specific mixing machine, but this should not be construed as limiting the embodiment of the method; modifications could of course be carried out without exceeding the scope of the invention as disclosed in the appurtenant patent claim.

Having described my invention, I claim:

1. An apparatus for mixing particulate components comprising a mixing chamber, first and second shafts supported in said chamber in substantially the same horizontal plane for rotation about parallel axes, means for rotating said shafts in opposite directions so that both shafts move upwardly at their adjacent sides, first blade means extending radially of said first shaft and disposed at an angle relative to its axis and operable upon rotation of said first shaft to transport said particulate components in a first axial direction through a transport zone disposed below said shafts, second blade means extending radially of said second shaft and disposed at an angle relative to its axis and operable upon rotation of said second shaft to convey said particulate components in a second axial direction opposite to said first axial direction through said transport zone, said first and second blades moving toward each other and upwardly in the region between said shafts and operable to move said particulate components through a mixing zone which is above and between said shafts, said first and second blade means being shaped and angled, and said rotating means causing said first and second blade means to rotate at a speed whereby said particulate material is fluidized and floats in said mixing zone, third blade means extending radially of said first shaft and disposed adjacent the downstream end thereof in the first axial direction, said third blade means being non-parallel to said first blade means and operable upon rotation of said first shaft to convey said particulate material toward said second shaft, and fourth blade means extending radially of said second shaft and disposed adjacent the downstream end thereof in the second axial direction, said fourth blade means being non-parallel to said second blade means and operable upon rotation of said second shaft to convey said particulate material toward said first shaft.

2. An apparatus as claimed in claim 1, said first and second blade means including a plurality of blades which are disposed at about a 45° angle relative to said first and second shafts, respectively.

3. An apparatus as claimed in claim 2, said third and fourth blade means including a plurality of blades which are parallel to said first and second shafts, respectively.

4. An apparatus as claimed in claim 1, said first and second blade means including blades having the same area and being disposed at the same angle relative to said first and second shafts, respectively.

5. An apparatus as claimed in claim 1, said first blade means including at least two stations each having four blades spaced 90° around said first shaft, said second blade means including at least two stations each having four blades spaced 90° around said second shaft, the blades of said first and second blade means being staggered relative to one another.

6. An apparatus as claimed in claim 1, said first and second blade means including a plurality of blades which are at substantially the same radial position relative to said first and second shafts, respectively, said means for rotating said first and second shafts being operable to rotate the blades of said first and second blade means at a peripheral velocity between about 1.1 m/sec. and about 1.8 m/sec.

7. A method of mixing particulate components which comprises the steps of delivering said components to a mixing chamber having disposed therein a first rotatable shaft provided with first and third blade means, and a second rotatable shaft parallel to said first shaft and provided with second and fourth blade means, said first and second shafts being in a horizontal plane, rotating said shafts in opposite directions causing said first and second blade means to engage and lift said particulate components between said shafts and said particulate components to become fluidized and float in a mixing zone which is between and above said shafts, causing said first and second blade means to transport said particulate components in first and second opposite axial directions in a transport zone which is below said shafts, and causing said third and fourth blade means to move said particulate components from the downstream end of said first shaft toward said second shaft and from the downstream end of said second shaft toward said first shaft, respectively.

8. The method of claim 7, said first and second blades being rotated at a peripheral speed of from about 1.2 m/sec. to about 1.8 m/sec.

* * * * *